US005121923A

United States Patent [19]

D'Allura

[11] Patent Number: 5,121,923

[45] Date of Patent: Jun. 16, 1992

[54] GOLF TRAINING DEVICE

[76] Inventor: John D'Allura, 32562 La Calma, San Juan Capistrano, Calif. 92675

[21] Appl. No.: 783,378

[22] Filed: Oct. 28, 1991

[51] Int. Cl.[5] ..... A63B 69/36

[52] U.S. Cl. ..... 273/185 C; 273/197 A; 206/315.9; 206/315.1

[58] Field of Search ..... 273/184 R, 184 B, 185 R, 273/185 C, 185 D, 197 A; 73/379

[56] References Cited

U.S. PATENT DOCUMENTS

| | | | |
|---|---|---|---|
| 2,929,632 | 3/1960 | Moffet | 273/185 |
| 3,406,571 | 10/1968 | Hackey | 73/379 |
| 4,113,257 | 9/1978 | Moffet | 273/185 |
| 4,496,156 | 1/1985 | Centafanti | 273/184 |
| 4,848,769 | 7/1989 | Bell et al. | 273/184 |
| 4,861,035 | 8/1989 | Page | 273/184 |
| 4,932,660 | 6/1990 | Wang | 273/185 |

OTHER PUBLICATIONS

Applicant: John D'Allura, Title: Improved Golf Training Device, File: Oct. 1991.

*Primary Examiner*—George J. Marlo

*Attorney, Agent, or Firm*—Geroges A. Maxwell

[57] ABSTRACT

A golf training device comprising a vertical stand projecting up from a playing surface, a horizontal arm projecting from the stand, an elongate connector part rotatably carried by and projecting radially from the arm on a central radial turning plane concentric with the arm; a golf ball on the end of the part remote from the arm; and, a pair of annular guides on spaced radial plane concentric with the central radial turning plane and between which said part normally freely projects and that engage and direct said part toward said central radial turning plane when it has been caused to turn on a plane eccentric thereto.

10 Claims, 4 Drawing Sheets

GOLF TRAINING DEVICE

BACKGROUND OF THE INVENTION

In the sport of golf a player advances a golf ball along a predetermined course by striking the ball with a golf club(s). Portions or legs of most golf courses along which players must advance their golf balls are often hundreds of yards long and are such that golfers must strike their golf balls with great force and velocity to drive the balls as far as possible in order to complete such legs of the courses with as few strokes as possible. The art of striking golf balls great distances is referred to as driving and is distinguished from the arts of striking golf balls short distances, which are generally called chipping or putting.

The art of driving golf balls requires the exercise of great and special skill. If balls are to be driven effectively great distances, they must be struck with clubs that are swung with great velocity and force. If the balls are to reach the areas of the courses which the golfers have targeted, the clubs must strike the balls at proper predetermined angles. When the angles at which the balls are struck deviate laterally from proper angle to cause the balls to be driven to the left of the golfers (right-handed) and of their intended targets, they are said to have been "hooked"; and, when so struck to cause the balls to be driven to the right of their golfers and their intended targets, they are said to have been "sliced." Since golf balls travel great distances when driven, when the angle at which they are hit is slightly misdirected or off angle, such slight off angle often results in the driven balls coming to rest at points that are far removed from their targets and, not infrequently, are driven out of the prescribed playing areas or bounds of the courses.

As a result of the foregoing, it is generally necessary that those who play golf spend many hours practicing the driving of golf balls to first develop and thereafter maintain practical driving skills.

To the above end, most golfing facilities provide golf ball driving ranges where golfers can practice driving golf balls to develop and hone their driving skills. Unfortunately, most golfers find that they have too little free time to make arrangements to visit and effectively utilize such driving ranges. Most golfers find that utilizing such ranges is inconvenient and impractical for reasons too numerous to be enumerated.

As a result of the above, there has been a long recognized need for a practical and serviceable devise that will enable golfers to practice driving golf balls at their homes, offices and other convenient sites where time and circumstances will best allow them to practice.

To the above end, the prior art has sought to provide golf ball driving practice devices which are such that they can be effectively set atop the ground or an appropriate deck wherever there is sufficient room for golfers, standing adjacent the devices and with golf clubs in hand, can fully and forcefully swing the clubs, to strike the golf balls that are a part of the devices, as though they were striking the balls while playing golf.

The most basic and practical kind of golf practicing devices provided by the prior art consist of an elongate vertical support or frame set upon the ground; and elongate horizontal arm projecting from the frame and having an outer free end spaced above a point on the ground where a golf ball might be advantageously set and struck with a club; a bearing at the outer end of and concentric with the longitudinal axis of the arm; an elongate connector part with an inner end connected with the bearing and normally depending from the bearing and the arm to near said point on the ground; and, a ball secured to the other free end of the connector part to normally occur in running clearance above said point on the ground. Upon striking the ball with a golf club, to drive it on the radial planes of the bearing, the ball is caused to rotate about the free end of the arm. The velocity at which the ball is driven determines the number of times the ball will turn about the arm. The number of times the ball turns about the arm is substantially proportional to the distance the ball would have traveled if it was free (unconnected) when struck or driven. Accordingly, the prior art has provided such devices with counting means that count the numbers of times the balls turn about the arms when driven and that translate the numbers of turns counted into the numbers of feet or yards the balls would have traveled if free when struck.

Prior art devices of the class briefly described above and here concerned with have proven to be seriously defective or wanting when the golf clubs miss the ball and strike the connector parts. If the connector parts are rigid metal parts, they are bent out of shape when so hit and must be carefully bent back into shape. They can only be bent out of and back into shape a rather limited number of times before they work harden and break. If they are made heavy and strong enough so that they will not readily bend out of shape when hit with golf clubs, they do irreparable damage to the clubs when they are hit thereby.

If the connector parts are flexible lines, such as wire cables, when they are struck by golf clubs they tend to wrap around the clubs or otherwise establish a purchase thereon with disastrous results. For example, the golfers can be seriously injured or their clubs and/or the devices can be irreparably damaged.

The noted prior art devices have also been found to be seriously deficient or wanting when golfers hook or slice the balls when striking them with their clubs. When the balls are hooked or sliced, they are caused to rotate eccentrically and wobble or gyrate violently about the axes of their related bearings and arms. The wobbling action tends to move the devices out of position. The eccentrically gyrating balls are subject to striking parts of the devices, the golf clubs and the golfers. More important and serious is the fact that when the balls are hooked or sliced and are caused to gyrate eccentrically as noted above, the misdirected dynamic forces are concentrated on the connecting parts where they join their bearings; causing those parts to bend back and forth repeatedly. The connecting parts soon work harden and break. They usually break at a time when the balls are initially impacted by clubs, with the result that the balls and their connecting parts are driven away, free from the devices, and are subject to doing great injury and/or damage.

There are some in the prior art who have sought to overcome the last-noted shortcoming in "tethered ball" type devices by providing self-aligning or shiftable bearing means that are intended to reduce the stress on the connecting parts where they join the bearings and that tend to let the balls gyrate more freely. While those efforts have reduced the rate at which the connector parts work harden and break to a notable extent, they ascerbate the hazards created by the eccentrically gyrating balls.

In other attempts to reduce the problems noted above, there are those in the prior art who have adopted and used light-weight simulated golf balls to reduce those potentially dangerous and/or damaging dynamic forces that are encountered when the balls are caused to gyrate eccentrically. The problem with using light-weight balls resides in the fact that they simply and clearly do not sound, feel or react like real golf balls when hit by a golf club.

U.S. Pat. No. 2,470,807, issued May 24, 1949 to C. F. Davis, Jr., discloses a golf practicing device of the general character here concerned with that includes a rigid shaft-like connecting part rotatably supported on a horizontal arm. The lower end portion of the connecting part is enlarged and angularly off-set. A simulated golf ball is connected to the lower end of the connecting part by a shock-absorbing means. A distance-indicating dial is driven by the shaft through or by means of an intermediate reduction gear train. Special effort is made to mount the ball remote from the connecting part so that it is less likely to be hit by a golf club. Striking the shaft with a golf club is likely to cause irreparable damage to both the shaft and the club. No provision is made to deal with those adverse dynamic forces that are encountered when the ball is sliced or hooked when struck by a club.

U.S. Pat. No. 2,929,632, issued May 22, 1960 to C. D. Moffatt, teaches the basic kind of practice device here concerned with, wherein a light-weight ball is carried at the end of an elongate flexible wire cable that extends to and is connected with an annular bearing ring on a horizontal arm. The bearing is in space relationship between two widely spaced stops on the arm and between which the ring can freely slide back and forth when the ball is sliced or hooked, when hit by a club. Thus, premature work hardening and breaking of the cable, where it connects with the bearing ring, is reduced.

U.S. Pat. No. 4,113,257, issued Sept. 12, 1978 to C. D. Moffatt, teaches an improved simulated golf ball for use in the device which is the subject matter of U.S. Pat. No. 2,929,632.

U.S. Pat. No. 4,496,156 issued Jan. 29, 1985 teaches a device similar to the Moffatt device but in which the means connecting the ball to the bearing on the arm is an articulated assembly including both rigid and flexible sections. The rigid section is carried by an axially shiftable bearing ring or sleeve and carries a pusher means that engages and actuates a button counter on the arm. The button counter displays the number of times the ball turns about the arm each time the ball is struck. The number of turns counted by the counter indicates the distance the ball would have traveled if it were free when struck.

U.S. Pat. No. 4,861,035 issued Aug. 31, 1989 to J. V. Page, teaches yet another form of the basic kind of device here concerned with. In this device a flexible tether for the ball is intentionally caused to wrap around an arm to cause the ball to strike and close a switching device on the arm when the ball is struck squarely. When the switching device is closed, a bell or other signalling device is sounded.

U.S. Pat. No. 4,932,660 issued June 12, 1990 to A. Wang, teaches an improved bearing means for the basic form of device that is taught by the above-noted patents to Moffatt. Wang's improved bearing includes a semi-universal ball joint to which the cable tether is connected. The universal ball joint, in addition to preventing work hardening of the cable tether, serves to prolong eccentric gyrating of the ball, when it is sliced or hooked when struck. Prolonged eccentric gyration of the ball affords the golfer time to observe the extent to which the ball is gyrating and thereby better appreciate the extent to which the ball was hooked or sliced.

U.S. Pat. No. 3,406,571 issued Oct. 22, 1968 to D. Hackey; and, U.S. Pat. No. 4,848,769 issued July 18, 1989 to J. A. Bell, et al., are of particular interest in that they show golf practice devices which are quite different from the basic kind of device which is the subject matter of the several above-noted patents, but in which the same or similar ends are sought to be obtained.

OBJECTS AND FEATURES OF THE INVENTION

It is a feature of this invention to provide an improved golf training device that is characterized by an elongate vertically extending supporting stand or frame with upper and lower ends; an elongate horizontal arm with a rear end secured to the upper portion of the frame and a free forwardly end; a bearing carried by the forward end portion of the arm and having a rotating part on an axis concentric with the longitudinal axis of the arm; a golf ball; and elongate connector part with an inner end connected with said bearing part and an outer end connected with the ball and normally depending vertically from the bearing part and supporting the ball in limited predetermined spaced relationship above the ground and in forward space relationship from the frame.

It is a feature of the invention to provide a device of the general character referred to above wherein the connector part is a thin flexible and resilient elongate part the inner and outer ends of which are in substantial fixed position with their related bearing part and ball. The connector part is adapted to turn with the bearing part on a predetermined turning plane that is normal to the axis of the arm when the ball is struck by a golf club and is driven in a direction tangential with said turning plane. The connector part flexes axially forwardly and rearwardly relative to the turning plane when the ball is struck by a golf club and is driven in a direction angularly off-set from tangent with said turning plane and turns eccentrically about the axis of the arm. Said device includes axially spaced front and rear annular guides in radial spaced relationship from the bearing assembly and spaced axially forward and rearward from said turning plane, to engage the connector part, between its ends, when it is caused to flex axially rewardly and forwardly (when the ball is driven to turn eccentrically about the arm) and work to direct the connector part and the ball to turn about the arm on said turning plane.

It is an object and feature of the invention to provide an improved device of the general character referred above wherein the guides function to rapidly absorb and to thereby dampen and substantially extinguish those adverse dynamic forces that are generated when the ball is driven to rotate eccentrically about the arm; serves to limit flexing of the inner end of the connector part (where it connects with its related bearing part) to an extent that is well below the modulous of elasticity of the material of which it is made so that it is not subject to work hardening and breaking; and, serves to distribute the adverse dynamic forces throughout an extensive portion of the connector part between its ends so that no limited or short portion of the connector part is likely to be adversely affected by those forces when the device if put to its intended use.

It is another object and feature of the invention to provide a device of the general character referred to above wherein the annular guides are axially resilient or shiftable so that they are yieldingly displaced forwardly and rearwardly in advance of the connector part when it is moved axially into engagement therewith; so that the axially directed dynamic forces encountered are most safely and effectively transmitted from the connector part into the guides where they are spent.

Another object and feature of the invention is to provide a device of the general character referred to above wherein the front and rear annular guides are preferably axially rearwardly and axially forwardly projecting annular rim-like parts or portions on or carried by front and rear radially extending carriers in the form of disks that are carried by and are concentric with the arm.

It is yet another object and feature of the invention to provide a device of the general character referred to above wherein the carriers or disks for the flexible annual guides are flexible and such that when portions of the annular guides are axially deflected by the connector part, the portions of the disks adjacent thereto are yieldingly deflected axially in advance thereof. The extent to which portions of the guides and the disks are deflected is proportional to the magnitude of the axial forces directed onto them by the connector part. Those forces are directly proportional to the magnitude of the forces directed onto the ball when struck or driven by a club that caused the ball to move from the turning plane and to rotate eccentrically. The device includes means to read and/or measure the extent to which the guides and/or their disks are deflected and to translate and display the magnitude of measured deflection in force units.

Another object and feature of the invention is to provide an improved device of the general character referred to above including means to time the rate of rotation of the ball about the arm when the ball is struck and driven by a golf club and to translate and suitably display the timed rate into the equivalent yards and/or feet the ball would have traveled if it had been free when struck.

Is is another object and feature of the invention to provide a device of the character here concerned with wherein the distance the connector part first moves circumferentially of the annular guides before it first contacts the guides, after the ball is struck with a slice or a hook, varies according to the velocity at which the ball is driven when struck and the angle at which the ball is sliced or hooked; the device includes means to read the velocity at which the ball is driven and the distance the connecting part moves circumferentially of the guides before it contacts the guides and that operates to compare and translate the velocity and the distance measured into the approximate angle at which the ball was sliced or hooked and to suitably display that angle.

An object and feature of the invention is to be provide a device of the character referred to above wherein the connector part can be a rather stiff resilient and flexible metal cable or a length of high tensile strength resilient wire and such that it will not bend to hook or catch a part of a golf club driven into engagement therewith during normal intended use of the device.

Finally, it is an object and feature of the invention to provide a device of the general character referred to above including a novel, collapsible frame to support the arm; and, a novel weighted platform for the frame that enables the device to be advantageously set upon and used atop substantially any stable flat surface; and that enables the device to be folded up for easy transportation, storage and for easy and convenient merchandising.

The foregoing and other objects and features of the invention will be fully understood and will be apparent from the following detailed description of the invention throughout which description is made to the accompanying drawings.

DESCRIPTION OF THE DRAWINGS

FIG. 7 is an isometric view of another embodiment of the invention;

DETAILED DESCRIPTION OF THE INVENTION

Figures 1, 2, 3, 4, 5:
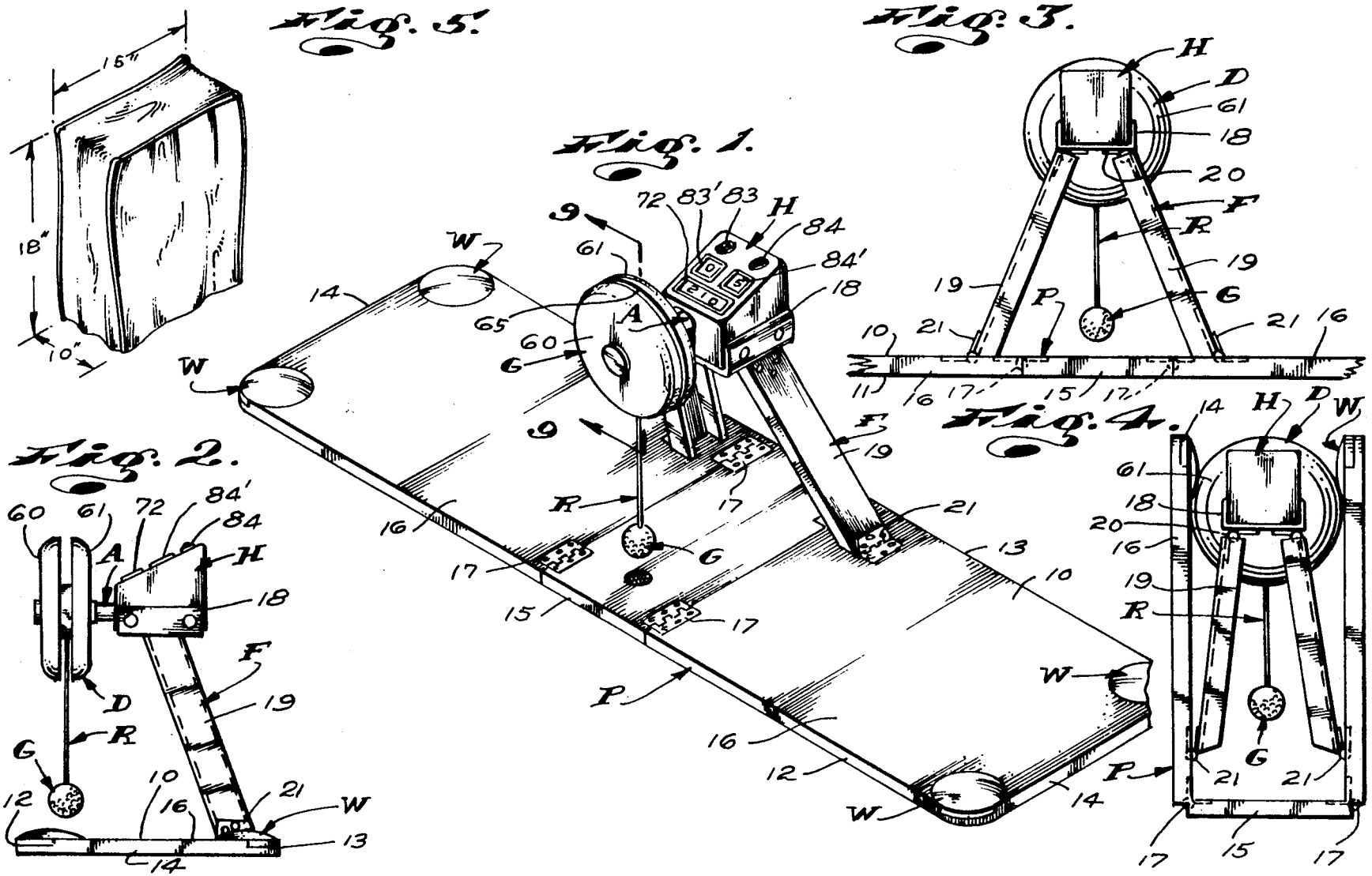
FIG. 1 is an isometric view of a golf training device embodying the invention.
FIG. 2 is a side view of the device.
FIG. 3 is a rear view of the device.
FIG. 4 is a view similar to FIG. 3 with parts in another or folded position.
FIG. 5 is a isometric view showing a cover for the device when folded.
Figure 6:
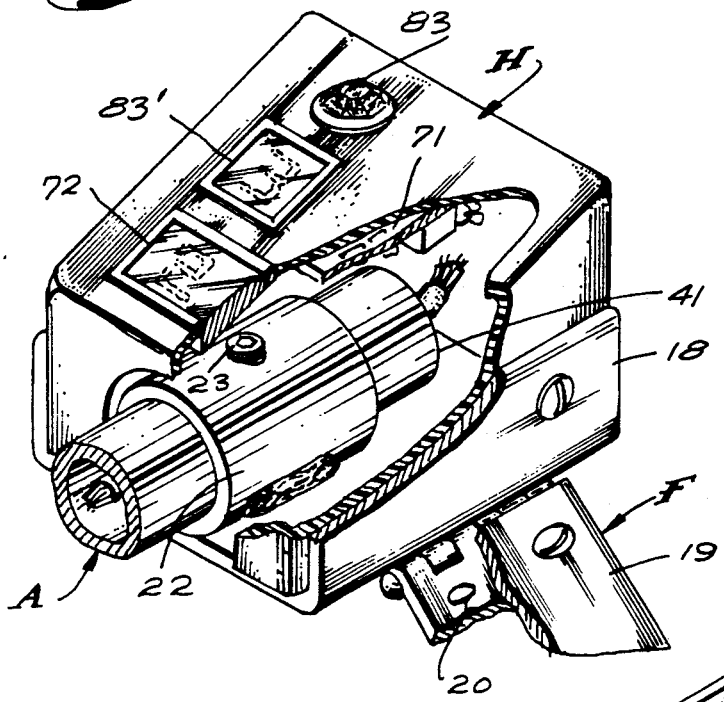
FIG. 6 is an enlarged isometric view of a portion of the structure shown in FIG. 1 with portions broken away to better illustrate details of the invention.

In FIGS. 1 through 5 of the drawings I have shown one preferred embodiment of my new Golf Training Device. The device includes a ground or deck supported platform P with flat horizontal top and bottom surfaces 10 and 11, front and rear edges 12 and 13 and opposite side edges 14. The platform can be made of plywood or other suitable material and is, for example, about 15" wide (front to rear) and about 64" wide (side to side). In the form of the invention illustrated, the platform is divided, laterally, into three sections, there being a central section 15 and two side sections or wings 16. The adjacent related edges of the sections 15 and 16 are hingedly connected together by means of suitable hinges 17.

When the device is in use, the several sections of the platform are horizontally disposed, as shown in FIGS. 1, 2 and 3 of the drawings. When the device is out of use, the wing sections 16 are pivoted up relative to the central section 15 to the position shown in FIG. 4 of the drawings. When folded up, the device can be covered with a suitable plasticized fabric cover, as shown in FIG. 5 of the drawings and establishes a neat and compact unit that is easy and convenient to store and transport and that measures approximately 10" in width, 18" in height and 15" in depth.

In practice, if the mass of the platform is not sufficient to prevent the sections from pivoting and working relative to each other when the device is in use, I provide metal weights W at the outside corners of the sections 16, as best shown in FIG. 1 of the drawings.

The golf training device that I provide next includes an upwardly projecting stand or frame F mounted on and carried by the platform P. The stand or frame F is positioned intermediate the opposite side edges of the platform and adjacent the rear edge thereof.

The stand or frame F is preferably an A-frame structure and includes a central upper header 18 and a pair of laterally outwardly and downwardly extending legs 19. The header 18 is a short upwardly opening channel section that extends front to rear. The legs 19 are elongate channel sections with inner upper ends and outer lower ends. The inner upper ends of the legs terminate adjacent the bottom of the header and are pivotally connected with the header by means of suitable hinges 20. The outer lower ends of the legs are oppositely inclined and diverge downwardly, from the header, toward the opposite sides of the platform P to terminate adjacent the inner side portions of the side or wing sections 16 of the platform. The legs are pivotally connected with their related sections 16 of the platform by suitable hinges 21.

When the golf training device is folded up, as shown in FIG. 4 of the drawings, the outer lower ends of the legs 19 move upwardly and laterally inwardly with their related wings 16 and pivot laterally inwardly relative to the header 18.

With the relationship of parts set forth above, it is possible to spread the lower ends of the legs 19 and impart the A-frame F with a wide base having great strength and rigidity, while enabling the structure to be folded up into a compact unit of no more than 10" in width, when not in use.

In the embodiment of the invention under consideration and as best seen in FIG. 2 of the drawings, the legs 19 are also pitched or inclined forwardly and upwardly so that the A-frame is slightly cantilevered whereby the forward end of the header 18 overlies the central and forward portion of the platform and so that a clear and unobstructed area of substantial extent occurs below the forward end of the header 18.

Figure 8:
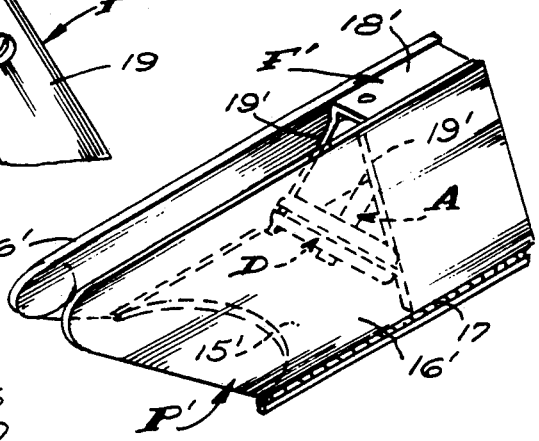
FIG. 8 is an isometric view showing the structure in FIG. 7 in a folded position.
Figure 2:
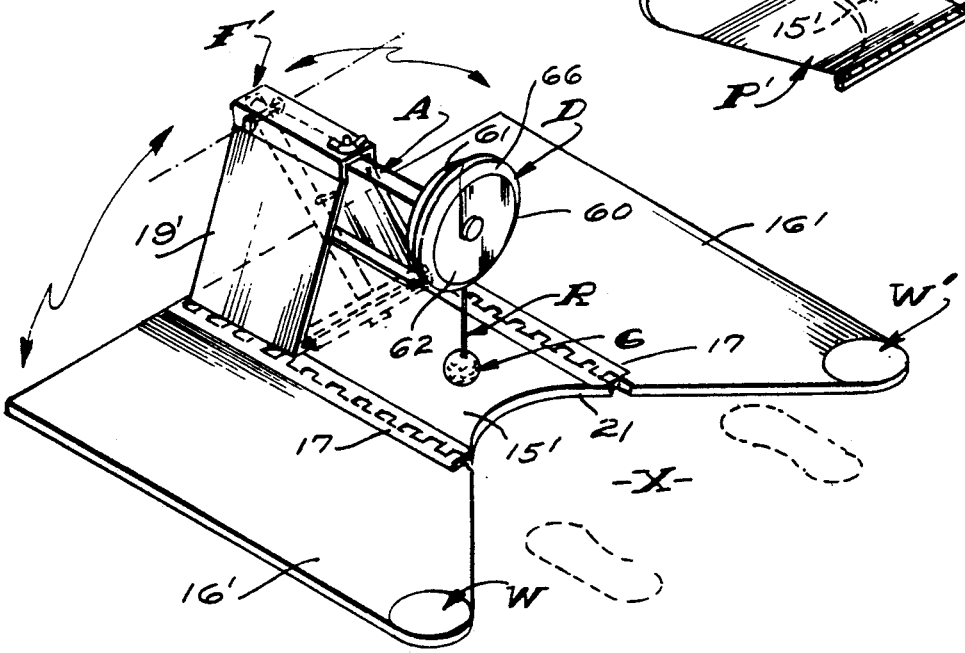

Referring to FIGS. 7 and 8 of the drawings, I have shown an alternate form of platform P' and standard or A-frame F'. The platform P' has central and side or wing sections 15' and 16' that are pivotally connected by hinge means 17'. The platform P' differs from the platform P in that the outer side portions or sections 16' are extended forwardly and are provided with weights W' at the outer forward corners. The central forward portion of the platform P' is relieved as indicated at 21 to provide a standing recess X where a golfer can comfortably stand while using the device.

The frame F' is a unitary sheet metal part having a header portion 18' and a pair of laterally outwardly and downwardly extending legs 19' integrally joined with the head. The lower ends of the legs 19' are fastened to their related side edge portions of the central section 15' of the platform P'. The lower ends of the legs have laterally inwardly projecting flanges that are screw-fastened to the section 15'.

When the device shown in FIG. 7 is not in use, the side or winglike sections 16' of the platform are pivoted upwardly and inwardly to overlie their related legs 19' and to establish a small compact unit that can be easily and conveniently transported and stored.

The golf training device that I provide next includes an elongate horizontal arm A carried by the header 18 of the frame F and projecting freely forwardly therefrom. The arm A has a rear end portion that is slidably engaged in a mounting ring or sleeve 22 fixed to the head; as clearly shown in FIG. 5 of the drawings. The arm A is secured in fixed axial and rotative position in the sleeve 22 and relative to the header 18 of the frame F by a set screw 23.

The arm A is shown as an elongate horizontal tubular metal part with front and rear ends 40 and 41, a cylindrical exterior surface 42 and a central passage 43. The rear end portion of the arm A, as noted above, is supported by the header of the frame F. The forward end portion of the arm A projects freely forwardly from the frame in vertical spaced relationship above the platform P.

The forward portion of the arm is formed with a flat longitudinally extending radially outwardly disposed flat 44 and three longitudinally spaced pairs of radially outwardly opening annular stop-ring grooves, there being a rear pair of grooves 45—45', a central pair of grooves 46—46' and a forward pair of grooves 47—47'. Finally, the arm is formed with a pair of axially spaced radial ports, there being a rear port 48 between the rear and central pairs of grooves and a forward port 49 between the central and forward pair of grooves, as clearly shown in FIG. 12 of the drawings.

Arm A is made of steel and is an effective electrical conductor that can be used to connect certain electrical components that are or might be provided in different embodiments of the invention.

The arm A carries an anti-friction bearing B. The bearing B includes an inner annular race ring 50 and outer annular race ring 51 and an annular series and balls 52 between the races 50 and 51. The inner bearing race 50 is slidably engaged about the arm A and is positioned between the central pair of snap ring grooves 46—46' and is releasably kept therebetween by snap rings S engaged in those grooves.

Figure 9:
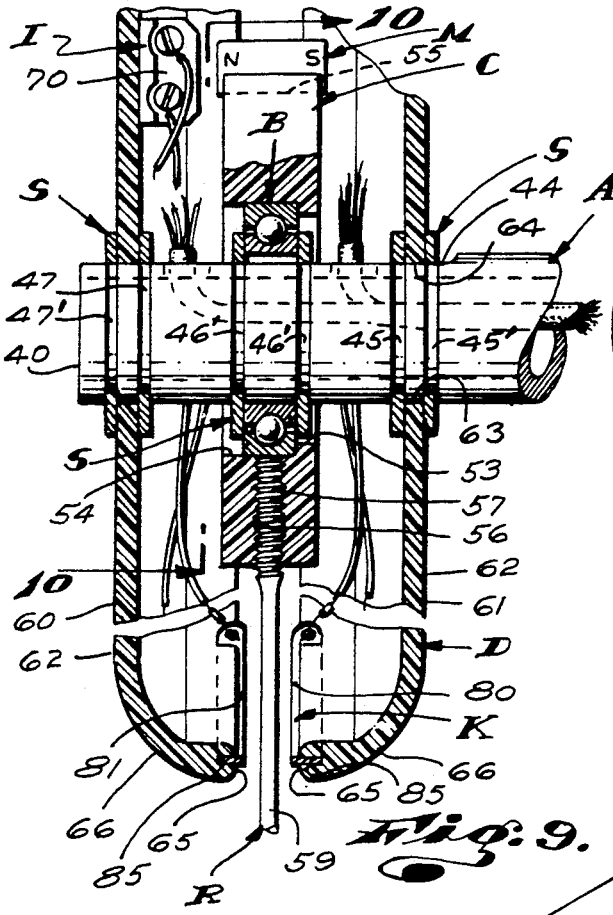
FIG. 9 is an enlarged detailed sectional view taken substantially as indicated by Line 9—9 on FIG. 1.
Figure 10:
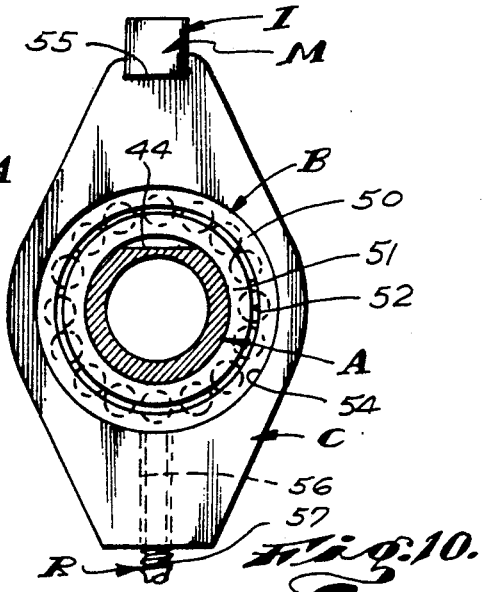
FIG. 10 is a view taken substantially as indicated by Line 10—10 on FIG. 9.
Figure 11:
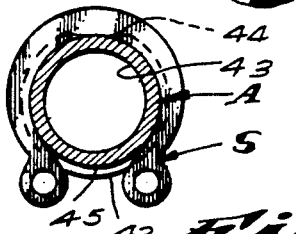
FIG. 11 is a sectional view showing a detail of the structure shown in FIG. 10.

The outer bearing ring 52 carries a block C. The block C is an elongate part that is, in the form of the invention illustrated, formed of a suitable diaelectric plastic material. The block B has a central through opening or bore 53 through which the arm A freely extends and a counter-bore 54 in which the outer race ring 52 of the bearing B is suitably press-fitted, as clearly seen in FIGS. 8 and 9 of the drawings.

In the embodiment of the invention now under consideration, the block C has a seat 55 formed in one of its ends. An elongate permanent magnet M is engaged and suitably secured in the seat 55. The magnet M is in radial spaced relationship from the central longitudinal axis of the arm A and bearing B and extends parallel therewith, with its north and south poles close to the front and rear surfaces of the block, as shown in FIG. 8 of the drawings.

The block C next and finally has an elongate radially extending internally threaded opening 56 entering its other end and opening at the counter-bore 54. The opening 56 threadly receives a threaded inner end portion 57 of an elongate connecting part R that extends radially outward from the central axis of the arm, bearing and block subassembly on the central radial turning plane of the device.

The connector part R has an outer end portion 58 that connects with and carries a common or standard golf ball G and an elongate intermediate portion 59 that extends radially between the block C and the ball G.

Figure 12:
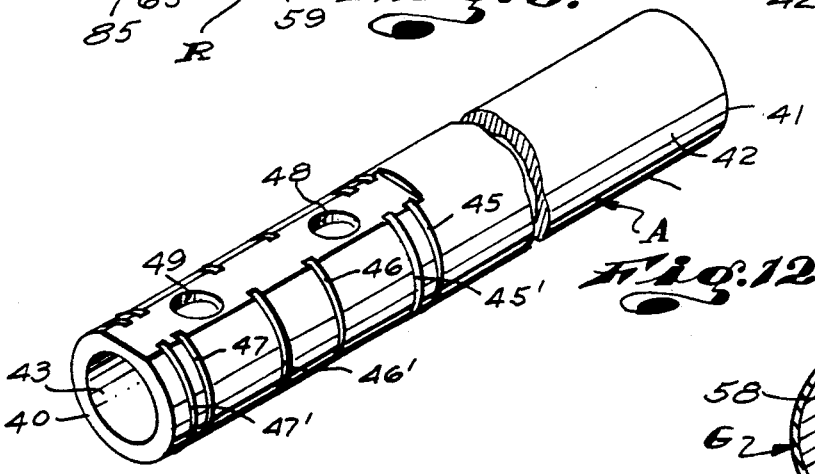
FIG. 12 is an isometric view of a part of the structure shown in FIG. 10.
Figure 14:
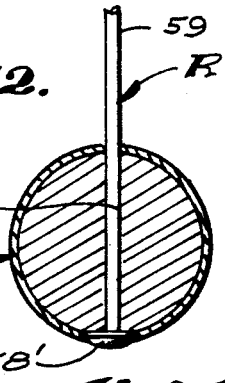
FIG. 14 is a view showing the golf ball of the device engaged on its related connector part.
Figure 13:
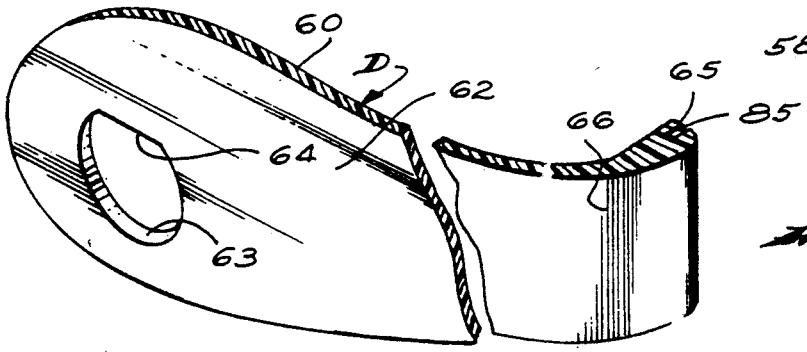
FIG. 13 is an isometric view of a portion of the structure shown in FIG. 9.

The portion 58 of the part R extends radially through an opening drill or otherwise formed in the ball G and has an enlarged ball-retaining head 58' formed at its outer free end, as shown in FIG. 12 of the drawings. In the form of my invention now under consideration, the connecting part R is a common bicycle spoke made of high-grade spring steel (the normally laterally turned headed outer end of which has been straightened).

In addition to carrying the ball G, the connector part R is an electrical contact, the inner end of which is electrically connected to the arm A through and by means of the bearing B. Thus, if the block C is made of dialectric plastic material, it is necessary that the inner end portion 57 of the connector part R be advanced through the opening 56 in the block, into contacting engagement with the outer race 51 of the bearing B. The bearing B, which is a steel structure, establishes an electrical connection between the part R and the arm A.

The golf training device that I provide next includes guide means D that operates to cause the connector part R, with the ball G at its outer end, to extend radially from the arm A and bearing B on the central radial turning plane of the device, when the part R and ball G are caused to turn or rotate about the arm.

In the preferred embodiment of my invention, the guide means G includes two like oppositely disposed axially spaced guide parts carried by and projecting radially from the arm A. There is a forward guide part 60 positioned on the arm A axially forward of the bearing B and the connector part R and a rear guide part 61 positioned on the arm A axially rearward of the bearing B and the connector part R.

The guide parts 60 and 61 are preferably established of a suitable flexible and resilient dialectric plastic material. In the form of the invention illustrated, each guide part is characterized by a substantially flat, radially extending disc portion 62 with a central cylindrical opening 63 through which the arm A is slidably engaged and that is formed with an orienting flat 64 that opposes and establishes flat bearing engagement with the flat 44 on the arm A to orient and set the guide part in predetermined rotative position on the arm.

The guide parts 60 and 61 are positioned on the arm A between the front and rear pairs of grooves in the arm A and are kept in axial position on the arm by snap rings S engaged in those grooves as clearly shown in FIG. 8 of the drawings.

The disc portions 62 of the guide parts are spaced axially from the bearing B, block C and connector part R a distance to accommodate various electrical components and parts for the training device that are carried by the guard parts, while allowing for free rotation of the block C and connector part R about the arm A.

Each guard part has an outer annular edge or bearing surface 65 about its outer perimeter that is disposed axially toward the central radial turning plane of the device and that is in predetermined close running relationship with the central portion 59 of the connector part R.

In the form of the invention now under consideration, the annular bearing surfaces 65 are defined by edges of axially turned rim portions 66 about the perimeter of the disc portions 62 of the guard parts.

When the device that I provide is used and the ball G and connector part R are caused to rotate about the arm A on the central radial plane of the device, the part R is spaced from and turns freely between the bearing surfaces 65. If the ball G is caused to turn eccentrically and out or away from the central radial plane of the device (as a result of the ball being hooked or sliced when struck), the connector part R is caused to flex axially rearwardly and forwardly relative to the bearing and block assembly and to engage the bearing surfaces 65 as the ball gyrates about the arm A. The bearing surfaces 65 engage the central portion 59 of the part R, between the bearing B and ball G, materially limiting axial forward and rearward bending of the part R where it joins with the block C and causing the part R to yieldingly bow or bend throughout a substantial portion of its longitudinal extent. Thus, those axially resolved or directed forces that cause the ball to gyrate are distributed longitudinally of the part R and are directed thereby onto and through the guide means G. Thus, the guide means G functions to counter and to dampen the noted axially directed forces and to correct or straighten out the misdirected course of the ball and part R to that desired course which lies on the central radial plane of the device.

In practice, when the ball G is caused to turn eccentrically and to gyrate about the arm A in the manner set forth above, its course of rotation is most often corrected by the means D and it is caused to rotate on and about the central plane of the device in but one or two revolutions about the arm A.

It is preferred that the disc-like guide parts 60 and 61 of the means D be flexible and resilient parts and such that they will yieldingly move in advance of the connector part R when the axially directed forces directed upon them by the part R is substantial or great and so that a substantial amount of those forces are absorbed by and spent within the guide parts, and, so that the part R is to caused not bend excessively over or about the bearing edges 65, as might be the case if the parts 60 and 61 were unyielding.

Figure 15:
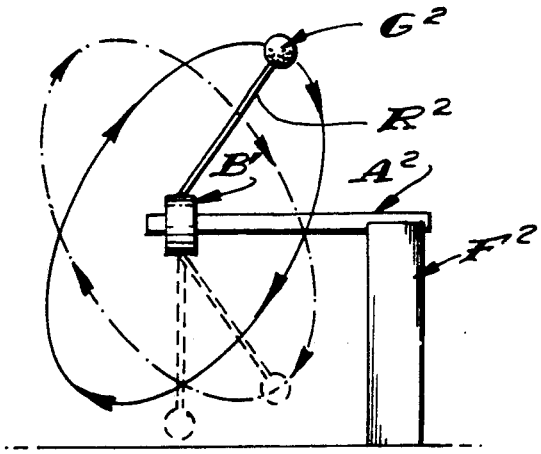
FIG. 15 is a view of a prior art device and diagrammatically illustrates the ball rotating eccentrically.

In FIG. 15 of the drawings, I have illustrated a typical prior art golf training device including a frame $F^2$, arm $A^2$, bearing $B^2$, connector part $R^2$, and ball $G^2$. The course in which the ball $G^2$ turns about the arm $A^2$ when it is sliced or hooked, is diagrammatically illustrated. It is to be noted that there is nothing to slow, limit or correct the gyratory motion of the ball $G^2$ and that while its gyratory movement will diminish as turning of the ball slows, it will likely gyrate excessiveley throughout a substantial number of revolutions about the arm $A^2$ before the inherent dangers associated with such gyratory movement of the ball subside to a safe degree.

Of equal importance it is to be noted that the axially directed forces in the device shown in FIG. 15 of the drawings are concentrated at the point of joinder of the part $R^2$ with the bearing $B^2$ and cause that portion of the part $R^2$ to bend back and forth as the ball gyrates. Such bending back and forth of the part $R^2$ is excessive, unrestricted and is such that it results in premature work hardening and breaking of the part $R^2$ at its point of joinder with the bearing $B^2$.

Figure 16:
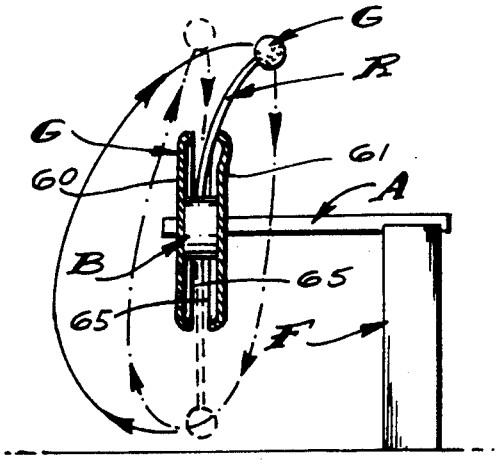
PRIOR ART Fig. 16.
FIG. 16 is a view of a device similar to the device shown in FIG. 15 embodying my invention; and, FIGS. 17, 18 and 19 are views of guide parts for different embodiments of my invention.

Reference in now made to FIG. 16 of the drawings which shows the basic form of prior art training device illustrated in FIG. 15 enhanced with my new guide means D. The path of movement of the ball G is illustrated in near that path that the ball would first travel if subjected to the same axial forces that cause the ball G', in FIG. 15 of the drawings, to move in its illustrated eccentric path. It is to be noted that the guide means D of my invention engages the central portion of the part R, between the bearing B and ball G, limiting axial displacement of the part R. Thus, the axial forces cause the part R to yieldingly bend throughout most of its longitudinal extent and result in those forces being transmitted into the means D. The portion of the guide part 61 engaged by the part R is shown yieldingly displaced axially rearwardly in advance of the part R and to thereby receive a substantial amount of the undesired axial forces. Still further, it will be apparent that the inner terminal end portion of the part R that joins the bearing B is subjected to a very limited degree of bending. The extent to which the inner end of the part R can bend is held below the modulous of elasticity of the material of which the part R is made and such that no problem of premature work hardening and breaking or failure of the part R, where it connects with the bearing B, is likely to occur throughout the anticipated useful life of the training device.

In practice, I have successfully used the molded plastic lids for food containers and toy flying saucers (Frizbees) to establish the guide parts 60 and 61 of the means D. I have also succesfully used metal pie tins and the like to establish the means D but found them to be undersirably noisy and subject to bending out of shape.

Figure 17:
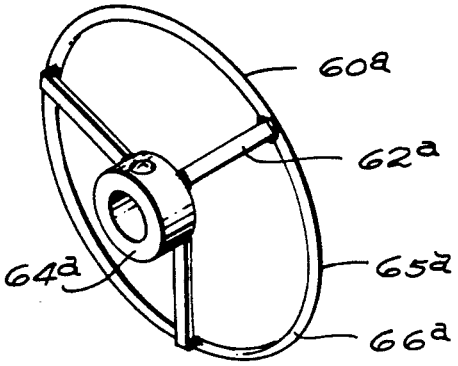

In FIG. 17 of the drawings, I have illustrated another form of guide part $60^a$. Guide part $60^a$ consists of or includes an annular ring $66^a$ that establishes the bearing surface 65. The ring $66^a$ is supported and carried by resilient flexible spokes $62^a$ that are fixed to and extend between the ring $66^a$ and a central tubular arm engaging hub $64^a$.

It is believed to be apparent that the guide means D can be provided in a considerable number of different forms without departing from the broader aspects and spirit of my invention. Substantially any structure that works to provide a pair of opposing axially spaced annular bearing surfaces, between which the central portion of the connector part R of the training device can move freely, when that portion of the part R turns about the central radial plane of the device and that is engaged by the part R when it is caused to rotate eccentrically will suffice to put my invention into practice.

In furtherance of my invention, to indicate and/or advise the user of the device how far the ball G would have traveled had the ball been free when struck by a golf club, I provide distance indicating means I that operates to measure the velocity at which the ball G is caused to move when struck and to translate that velocity into corresponding numbers of linear units such as feet and/or yards. The number of feet and/or yards is displayed for convenient reading by the user of the device.

It is to be noted that the distance a golf ball will travel is dependent upon the velocity imparted into it when impacted by a golf club.

In the embodiment of the invention as illustrated in the drawings, the means I includes the aforementioned magnet M carried by the block C. The magnet turns about the arm A when the ball G is struck and caused to rotate about the arm. The means I next includes a normally closed magnetically operated switch 70 mounted on the disc portion 62 of the guide 61 of the means D and that normally occurs adjacent to and in close operating relationship with the magnet M, to maintain the switch open (when the device is in its normal position and the connector part R depends from the arm A and the ball G is in stationary position below the arm). The switch 70 is connected with a pair of conductors that extend from the switch through the port 49 in the arm A and thence through and from the rear end of the passage 43 in the arm where they enter a housing H carried by the header of the frame F. The conductor connect with a circuit board (circuit) 71 within the housing H.

The means I next includes a digital display device 72 (an LCD device) that is mounted in an opening in the housing H so that it can be viewed by the user of the practice device and that is connected with the circuit.

When the ball G is struck and caused to turn about the arm A, the magnet M is immediately moved away from the switch 70, causing the switch 70 to close. The switch 70 remains closed until the ball and the magnet M completes one full revolution about the arm, at which time, the magnet is in close proximity with the switch and causes the switch to open. The circuit 71 operates to measure the time the switch was left to remain closed and, in effect, compares that time with the distance the ball traveled through one revolution about the arm to determine the velocity at which the ball was driven. The circuit next converts the velocity to a corresponding signal current and directs that signal current to the read-out device 72 that displays the number of feet and/or yards that the ball would have traveled if free when stuck.

In the course of reducing my invention to practice, I have experimented with and used a number of different kinds and/or types of circuits that effectively time and ascertain the velocity of the golf ball when struck and that cause the digital diplay device to display the number of yards the ball would have traveled, if free when stuck. Accordingly, the circuit one might use in putting my invention into practice is a matter of choice and no one particular circuit need be illustrated and described.

In practice the velocity of ball is greatest throughout its first revolution about the arm A and diminishes upon each successive revolution. Accordingly, the electric circuit is, in effect, armed when the switch 70 is first closed and performs its subsequent functions following (first) opening of the switch 70. The circuit is nonresponsive to subsequent closing and opening of the switch 70 as the ball continues to rotate about the arm.

Figure 18:
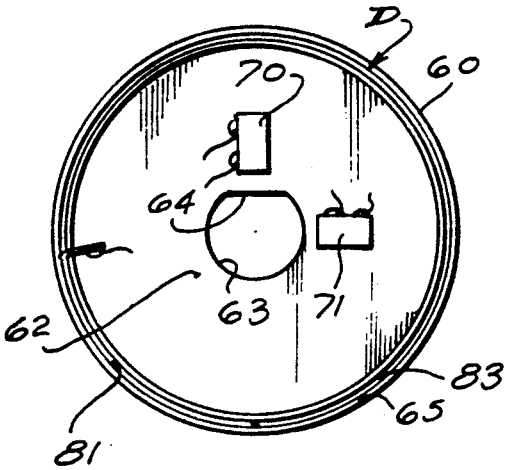

In practice it is possible to effectively and more accurately measure the velocity of the ball through the first quarter or first one-half of the first revolution of the ball about the arm. If it is desired to so enhance the operation of the device, the means I can be provided with a second normally closed magnetic switch 70' that is series connected with the switch 70 and mounted on the guide part 61, 90° from the switch 70 in the direction in which the ball rotates when struck. When the ball is struck and caused to rotate, the switch 70 closes first and sends a first signal to the circuit. When the ball advances 90° or one-quarter revolution, the switch 70' opens. causing the circuit to time the velocity of the ball through its first one-quarter of one revolution. In FIG. 18 of the drawings, I have shown a guide part 61 with pair of switches 70 and 70' as described above.

In practice my new training device can be and is shown as including slice and hook indicating means K that operates to indicate to the user of the training device whether he has hooked or sliced the ball when he strikes it with a golf club and that indicates the magnitude or the extent to which the ball was sliced or hooked. The means K includes a pair of axially spaced elongate semi-circular contact strips 80 and 81. Each strip is mounted on one of the guide parts 60 and 61 of the means D adjacent to and extending about a portion of the bearing surface 65 thereof. One end of each of the contact strips is connected with a related conductor line that extends therefrom through its related port 48 or 49 in the arm A, through and fro the passage 43 in the arm and that is suitably connected with a related section of the circuit 71. The said related section of the circuit board is suitably connected with the arm A and the connector part R (through the bearing B). When the part R is caused to engage one or the other of the contact strips, a closed-circuit is established through that strip, the part R, bearing B, arm A and circuit 71.

When the ball is sliced and caused to rotate eccentrically about the arm A, the part R is caused to first engage one of the contact strips, for example, it first contacts the strip 81. Likewise when the ball is hooked and rotates eccentrically about the arm A, the connector part R first contacts the other contact strip 80. The circuit 71 is suitably connected with a hook signal device 83 and a slice signalling device 84 mounted on the housing H to be viewed by the user of the training device. The circuit operates to energize the device 83 when the ball has been hooked and to energize the device 84 when the ball has been sliced.

It should be noted at this time that when the ball has been struck improperly so as to cause it to rotate eccentrically about the arm it is impossible to tell whether it was hooked or sliced by watching it gyrate about the arm. It can only be determined if the ball has been hooked or sliced if the user's eyes are on the ball at the moment of impact, which is seldom the case. Thus, the provision of the means K in my training device provides highly desirable information that other devices of similar nature do not provide.

The signalling devices 83 and 84 of the means K are shown as spaced apart signal lights or lamps carried by the housing H and each of which connected with a suitable power supply (not shown) and is under control of a suitable normally open switch (not shown) that closes in response to a output signal from the circuit and that includes a timing device (not shown) that keeps the switches closed for a desired period of time.

In the form of the invention disclosed, the contact strips 80 and 81 are elongate ribbon-like strips of conductive metal press-fitted into annular grooves 85 formed in the rim portions of the guide parts and opening axially at the bearing surfaces 65. The ribbon-like strips are engaged in the grooves so that only a small edge portion thereof projects outwardly from the grooves to becomes, in effect, conductive portions of the bearing surfaces 65.

As shown, the strips extend a substantial distance about the bearing surfaces 65, commencing from about bottom dead center of the guide parts and continuing in the direction in which the ball and connector part rotate.

In operation when the ball G is struck and caused to turn eccentrically about the arm A, the greater the misdirected axial forces are, the greater is the axial displacement of the ball and connector part R from the central radial plane of the training device and the longer the period of time the connecting part R will remain in contact with the contact strip it is first moved into contact with.

The above-noted contact time varies depending upon the velocity at which the ball is driven and upon the angle (from the normal radial plane of the device) at which the ball is driven. The noted contact time is not truly or accurately reflective of the magnitude and/or degree at which the ball is sliced or hooked. However, the period of time the part R contacts one of the contact strips, when the ball is sliced or hooked, is a reasonably good indicator of the magnitude and/or degree to which the ball was sliced or hooked when the magnitude or degree of a slice or hook is measured on a scale of, for example, one to ten. It has been determined that to measure the extent or degree to which a ball has been sliced or hooked on a scale of one to ten is quite adequate for the purpose of informing the user of my training device how good or poorly he is driving the ball and to take appropriate steps to correct deficiencies.

In accordance with the foregoing, the hook and slice indicating means K that I provide can and is shown as including digital read-out devices 83' and 84' to display numbers 1 to 0 and that are connected with the circuit 71. The circuit operates to measure the time the connector part R contacts the first-to-be-contacted strip and causes the appropriate digital read-out device 83' or 84' to display that digit which corresponds to the measured time, on a scale of 1 to 10.

In another embodiment of my invention, the magnet switch 70 of the means I was replaced by a light-emitting diode on one of the guide parts and a photoelectric cell mounted on the other of said guide parts and in operating relationship with the diode. The magnet M on the block B was replaced by a shutter plate that moved into and out of engagement between the cell and the diode when the ball of the device was driven and caused to rotate about the arm. It was determined that the noted related cell, diode and shutter were effective to attain the same end results as the switch and magnet they replaced and were the full mechanical equivalent thereof.

In another embodiment of my invention and as illustrated in FIG. 18 of the drawings, the contact strips 81 and 82 provided in the first embodiment of my invention are eliminated and in their stead, I provide a plurality (three) of circumferentially spaced strain gauges 100 on and about the central disc portions of the guide parts, in close proximity to the axially turned rim portions of those parts. In operation, when the connecting part R of the device is urged into engagement with the guide parts, the guide parts are distorted axially and circumferentially as the part R engages and advances circumferentially thereof. As the guide parts are distorted as noted above, the strain gauges are sequentially distorted or biased to a corresponding extent. The strain gauges 100 are connected with the electric circuit and the circuit, together with the strain gauges, operates to measure the degree to which the guide parts are distorted or displaced by the connector part R and to cause the slice and hook read-out devices of the means K to display the magnitude to which the guide parts are distorted and therefore the magnitude or degree to which the ball of the device has been sliced or hooked.

When reducing my invention to practice, I experimented with connecting parts of different lengths and with guide parts of different diameters. I found that if the ratio between the diameter of the guide parts to the length of the connector part is great, the speed at which the guide parts dampen eccentric gyration of the connector part and ball about the arm is greater than when the ratio between the diameter of the guide parts and the length of the connector part is small (less). However. when the above-noted ratio between the diameter of the guide parts and the length of the connector part is very great, as when the guide parts are but 4" in diameter and the connector part is 18" long, the dampening effect afforded by the guide parts is still notable and none of the other desired ends that my invention affords are in any way diminished.

Accordingly, the length of the connector part and the diameter of the guide parts might adopt when putting my invention into practice is a matter of choice.

As regards the material of which the connector part is made, I have found that certain twisted and braided wire materials and certain monofilament and multifilament plastic lines can be used with varying degree of success. In the embodiments of my invention illustrated, the length of the connector part is about 11" and the diameter of the guide parts is about 8". These dimensions of the noted parts has proven to be a good and practicable compromise in that it affords a structure with ample clearance between the guide parts and the ball to enable the user to conveniently observe the ball and which allows him to freely advance the head of a golf club below the guide parts when striking the ball. It also enables the size and weight of the training device to be held within highly desirable and practical limits.

Referring again to the first shown embodiment of my invention, it will be noted that the diameter of the guide parts 60 and 61 determine the lateral extent or width of the central portion or section 15 of the platform P and that the distance between the top of the parts 60 and 61 and the top of the platform P determines the lateral extent of the wing-like side sections of the platform P, if the training device is to establish a neat, square unit when folded up for storage.

Referring to FIGS. 7 and 8 of the drawings, the diameter of the guide parts 60 and 61 determines the width of the central section 15' of the platform P'. In this embodiment of the invention, the rear end of the arm A is pivoted to the header 18' of the frame F' so that the arm with the guide means thereon can be pivoted down, as shown in dotted lines, when the device is folded up and to thereby enable the sections 16' of the platform to pivot inwardly to lie adjacent to and parallel with the legs 19' of the frame, as shown. When the device is in use, the arm is releasably held up and in working position, by a screw fastener device carried by the arm and engaged through the header, as clearly shown in FIG. 7 of the drawings.

In a most recent embodiment of my invention, the magnetic switch 70 of the timing means I is replaced by an inductive pick-up device (magnetic field responsive device) relative to which the magnet M moves when the ball is driven and the magnet carried by the block C rotates about the arm and relative to the inductive pick-up device. The inductive pick-up device is less costly and more dependable and durable than the magnetic switch and the electric circuit required to be used therewith is less costly and far more power-efficient than the circuit that is required to be used with the magnetic switch.

Figure 19:
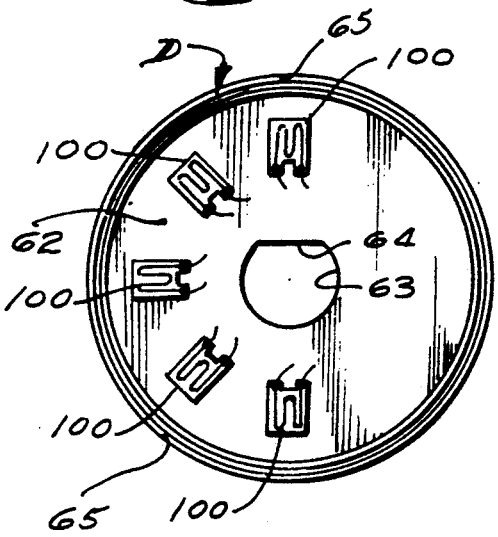

Also, in the most recent embodiment of my invention, the outer perimeter or flange portions 66 of the guide parts 60 and 61 are made flexible (less rigid). A plurality of circumferentially spaced Hall effect sensing devices are mounted on the central disc portions 62 of the guide parts adjacent the flange portions thereof; and, a magnet is mounted on and carried by the connector part R to move by the Hall effect devices in predetermined spaced relationship therewith when the part R is caused to rotate on and about the central turning plane of the training device. When the ball is hooked or sliced and the part R is urged into engagement with and displaces the flange portions of the guide parts axially, as described in the preceding, the spacing between the magnet on the part R and the Hall effect devices is varied and the resistance of those devices varies proportionately. The Hall effect devices are arranged on the guide parts in substantially the same way that the strain gauges 100 are arranged on the guide parts in that embodiment of the invention that is illustrated in FIG. 19 of the drawings. The electric circuit for use with the Hall effect devices is similar in nature to the circuit that is used with the strain gauges 100, but requires and/or consumes notably less power and can be made far more economically.

Having described only typical preferred forms and embodiments of my invention, I do not wish to be limited to the specific details herein set forth but wish to reserve to myself any modifications and/or variations that might appear to those skilled in the art and that fall within the scope of the following claims.

Having described my invention, I claim:

1. A golf training device comprising a stand projecting up from a playing surface, an elongate horizontal arm with a rear portion engaged with an supported by the stand and a front portion projecting forwardly from the stand in spaced relationship above the playing surface, an annular bearing engaged on and carried by the front portion of the arm for substantial free rotation about the longitudinal axis of the arm on a central radial turning plane, an elongate connector part with an inner end coupled with the bearing and extending radially therefrom on said central turning plane, a golf ball coupled with and carried by an outer free end of the connector part and in spaced relationship above the playing surface when the connector part depends vertically from the bearing, and, guide means to limit and resist deflection of the connector part forwardly and rearwardly from radial alignment with said central turning plane and including front and rear guide parts with annular bearing surfaces concentric with the axis of the arm and between which a central portion of the connector part normally freely extends in close running clearance therewith, the bearing, connector part and ball-/subassembly rotates about the arm on said central turning plane when the user of the device strikes the ball with a golf club to drive the ball in a direction parallel with the primary turning plane.

2. The golf training device set forth in claim 1 wherein the stand is an A-frame structure with a header which is engaged by and carries the arm and a pair of legs diverging laterally outwardly and downwardly from the header and relative to a central longitudinal vertical plane through the arm.

3. The golf training device set forth in claim 1 that further includes a normally flat horizontal ground engaging platform to which the stand is connected and from which the stand projects.

4. The golf training device set forth in claim 1 that further includes a normally flat horizontal ground engaging platform to which the stand is connected and from which the stand projects; said platform has corners spaced forward and laterally outward from the front end of the arm, rear corners spaced rearward and laterally outward from the stand and includes corner weights at said front and rear corners to normally maintain the platform horizontal atop the ground.

5. The golf training device set forth in claim 1 that further includes a normally flat horizontal ground engaging platform to which the stand is connected and from which the stand projects; the platform includes an elongate central section spaced below and in parallel relationship with the arm and to which the stand is connected, and, wing-like opposite side sections with inner edges pivotally connected with related edges of the central section; said side sections pivot upwardly and laterally inwardly relative to the central section to lie substantially parallel with and adjacent to the opposite sides of the stand when the training device is prepared for storage or transport.

6. The training device set forth in claim 1 that further includes a normally flat horizontal ground-supported platform comprising an elongate central section in spaced parallel position below the arm, normally flat horizontal wing-like opposite side sections with inside edges pivotally connected with related side edges of the central section, the side sections pivot upwardly and inwardly from horizontal positions to substantially vertical positions when the device is prepared for storage and transport, the stand is an A-frame structure and includes a header with which the rear portion of the arm is engaged and that occurs in vertical spaced relationship above the central section, a pair of elongate legs with upper inner ends pivotally connected with the header at opposite sides thereof and lower outer ends pivotally connected with related side sections of the platform, said legs pivot relative to the head and their related side sections toward parallel relationship to each other and with the side sections when the side sections are pivoted upwardly from horizontal to substantially vertical positions.

7. The golf training device set forth in claim 1 that further includes distance-indicating means to indicate the approximate distance the ball would have traveled after being struck had the ball been free from the connector part when struck, said distance-indicating means includes a switch carried by one of the guide parts in radial spaced relationship from the axis of the arm, a switch actuator carried by the subassembly comprising the bearing, connector part and ball, the actuator is positioned to actuate the switch when the ball is initially struck and to deactuate the switch when the actuator completes one revolution about the arm, an electric circuit with which the switch is connected and a digital read-out device connected with the circuit and disposed for viewing by the user of the training device, said circuit operates to measure the time the switch remains actuated after the ball is struck and to translate that measured time into a corresponding signal and to transmit that signal to the read-out device and cause said read-out device to display the distance the ball would have traveled if free when struck.

8. The golf training device set forth in claim 1 that further includes distance-indicating means to indicate the distance the ball would have traveled had the ball been free from the connector part when struck, said distance-indicating means includes a plurality of switches carried by the guard means in radial and circumferential spaced relationship about the axis of the arm, a switch actuator carried by the subassembly including the bearing, connector part and ball, said actuator is positioned to move into and out of actuating position relative to the switches when the ball is struck and the actuator is caused to rotate about the arm, an electric circuit with which the switches are connected and a digital read-out device connected with the circuit, the switches are sequentially actuated by the actuator when the ball is struck and caused to rotate about the arm, actuation of the switches causes the circuit to operate to measure the time the ball takes to rotate a predetermined distance and to direct a corresponding signal to the read-out device and to cause the read-out device to display a corresponding number of linear units.

9. The golf training device set forth in claim 1 that further includes slice and hook indicating means to indicate to the user of the device when the ball has been hooked or sliced and caused to rotate about the arm on planes that are eccentric with the central turning plane when the ball is struck, the slice and hook indicating means includes an electric circuit, an electric connection between the circuit and the connector part, a pair of elongate contact strips adjacent to and extending circumferentially of the bearing surfaces of the guide parts, each contact strip is connected with the circuit, and, a signal device connected with the circuit and operating to signal and advise the user of practice device if the ball was sliced or hooked when struck, when the ball is sliced or hooked the connector part is caused to first contact one of the contact strips and the circuit is caused to operate and cause the signalling device to signal if the ball is sliced or hooked.

10. The golf training device set forth in claim 1 that further includes slice and hook indicating means that indicates to the user of the device when the ball is sliced or hooked and caused to rotate about the arm on a plane eccentric with the central turning plane when struck, the slice and hook indicating means includes an electric circuit, an electric connection between the circuit and the connector part, flexible and resilient portions in the guide parts adjacent the contact strips, a plurality of strain gauges fixed to the flexible and resilient portions of the guide parts in circumferential spaced relationship thereabout, each strain gauge is connected with a related part of the circuit, and, a signaling device connected with the circuit to signal and advise the user of the training device when the ball has been sliced or has been hooked, when the ball is sliced or hooked the connector part is forceably moved into engagement with and distorts its adjacent portions of the guide part it is initially directed toward and as it moves circumferentially thereof and causes corresponding sequential biasing of the strain gauges, the circuit operates to compare the current flow through the strain gauges and to determine the extent to which the guide part first contacted by the connector part is distorted and causes the signalling device to signal and advise the user the approximate magnitude and degree that the ball was sliced or hooked when struck.

* * * * *